US006300908B1

(12) United States Patent
Jecko et al.

(10) Patent No.: US 6,300,908 B1
(45) Date of Patent: Oct. 9, 2001

(54) ANTENNA

(75) Inventors: Bernard Jean-Yves Jecko; Francoise Jecko, both of Rilhac Rancon (FR)

(73) Assignee: Centre National de la Recherche Scientifique (CNRS), Paris (FR)

( * ) Notice: Subject to any disclaimer, the term of this patent is extended or adjusted under 35 U.S.C. 154(b) by 0 days.

(21) Appl. No.: 09/530,901

(22) PCT Filed: Sep. 7, 1999

(86) PCT No.: PCT/FR99/02123

§ 371 Date: May 8, 2000

§ 102(e) Date: May 8, 2000

(87) PCT Pub. No.: WO00/14825

PCT Pub. Date: Mar. 16, 2000

(30) Foreign Application Priority Data

Sep. 9, 1998 (FR) ..... 98 11251

(51) Int. Cl.[7] ..... H01Q 1/38

(52) U.S. Cl. ..... 343/700 MS; 343/767; 343/769

(58) Field of Search ..... 343/700 MS, 767, 343/768, 769, 845, 846, 848; H01Q 1/38

(56) References Cited

U.S. PATENT DOCUMENTS

| | | | | |
|---|---|---|---|---|
| 2,885,676 | * | 5/1959 | Baldwin | 343/767 |
| 3,086,204 | * | 4/1963 | Alford | 343/708 |
| 3,216,016 | * | 11/1965 | Tanner | 343/719 |
| 4,063,246 | | 12/1977 | Greiser | 343/700 MS |
| 4,291,312 | * | 9/1981 | Kaloi | 343/700 MS |
| 4,367,475 | | 1/1983 | Schiavone | 343/767 |
| 4,766,440 | | 8/1988 | Gegan | 343/700 MS |
| 4,873,529 | * | 10/1989 | Gibson | 343/700 MS |
| 5,565,875 | * | 10/1996 | Buralli et al. | 343/700 MS |
| 5,872,542 | * | 2/1999 | Simons et al. | 343/700 MS |

FOREIGN PATENT DOCUMENTS 0 375 415 6/1990 (EP) .

* cited by examiner

*Primary Examiner*—Tan Ho
*Assistant Examiner*—Shih-Chao Chen
(74) *Attorney, Agent, or Firm*—Finnegan, Henderson, Farabow, Garrett & Dunner, L.L.P.

(57) ABSTRACT

An antenna of the type comprising a first electrically conductive surface (12), a second electrically conductive surface (14) forming a ground plane parallel to the first electrically conductive surface, and a first electrically conductive feed wire or strip (16) is provided. The first electrically conductive feed wire or strip (16) links a first terminal of a generator/receiver (20) to the first electrically conductive surface (12). A second electrically conductive feed wire or strip (17) links a second terminal of a generator/receiver (20) to the second electrically conductive surface (14). At least one electrically conductive wire or strip (18, 19) links the first electrically conductive surface (12) and the second electrically conductive surface (14). The first electrically conductive surface, the second electrically conductive surface, and the at least one electrically conductive wire or strip (18, 19) linking the first and second electrically conductive surfaces (12, 14) are all coplanar.

15 Claims, 4 Drawing Sheets

ANTENNA

BACKGROUND OF THE INVENTION

1. Field of the Invention

The present invention relates to the field of antennas.

More precisely still the present invention relates to the field of antennas operating with regard to a particular mode comprising:

a first electrically conductive surface, generally dubbed a "capacitive roof", a second electrically conductive surface forming a ground plane, parallel to the first surface, a first electrically conductive feed wire or strip which links a first terminal of a generator/receiver to the first surface and a second feed wire or strip which links a second terminal of the generator/receiver to the second surface, and at least one electrically conductive wire or strip which links the two aforesaid surfaces.

2. Description of the Related Art

Examples of such antennas are described, for example in the documents FR-A-2 668 859 and EP-A-667 984.

Thus, the document FR-A-2 668 859 has described an antenna of the aforesaid type comprising a single wire or strip linking the two surfaces, which wire or strip is arranged so as to be traversed by a current at the working frequency and so as to be coupled by inductive coupling to the feed wire or strip linking the generator to the first surface. It has been shown that this antenna generates, under certain conditions of layout of the elements, a radiation of monopole type, that is to say comprising an axisymmetric lobe, with maximum radiation parallel to the ground plane and zero radiation perpendicular to the antenna, linear polarization with electric field in a plane perpendicular to the antenna and near hemispherical coverage except on the axis.

The document EP-A-667 984 describes a variant of this antenna comprising several parallel wires or strips linking the two surfaces. This arrangement makes it possible in particular to facilitate the matching of the antenna to the generator.

The antennas of the aforesaid type have already rendered great service.

BRIEF SUMMARY OF THE INVENTION

The aim of the present invention is however to propose a novel antenna which can take reduced dimensions with respect to the working wavelength not only in the horizontal plane like the antennas described in the documents FR-A-2 668 859 and EP-A-667 984, but also in the vertical direction where the height is very small of the order of $\lambda/200$.

This aim is achieved within the framework of the present invention by virtue of the antenna of the aforesaid type, characterized in that the two surfaces and the wire(s) or strip(s) for linking these surfaces are all coplanar.

As appropriate at least the wire or strip ensuring the link between the generator/receiver and the first surface is also coplanar with the aforesaid elements.

BRIEF DESCRIPTION OF THE DRAWINGS

Other characteristics, aims and advantages of the present invention will become apparent on reading the detailed description which follows and in conjunction with the appended drawings, given by way of non-limiting example, and in which FIG. 1 diagrammatically represents the general structure of an antenna in accordance with the present invention.

DETAILED DESCRIPTION OF THE INVENTION

Figure 1:
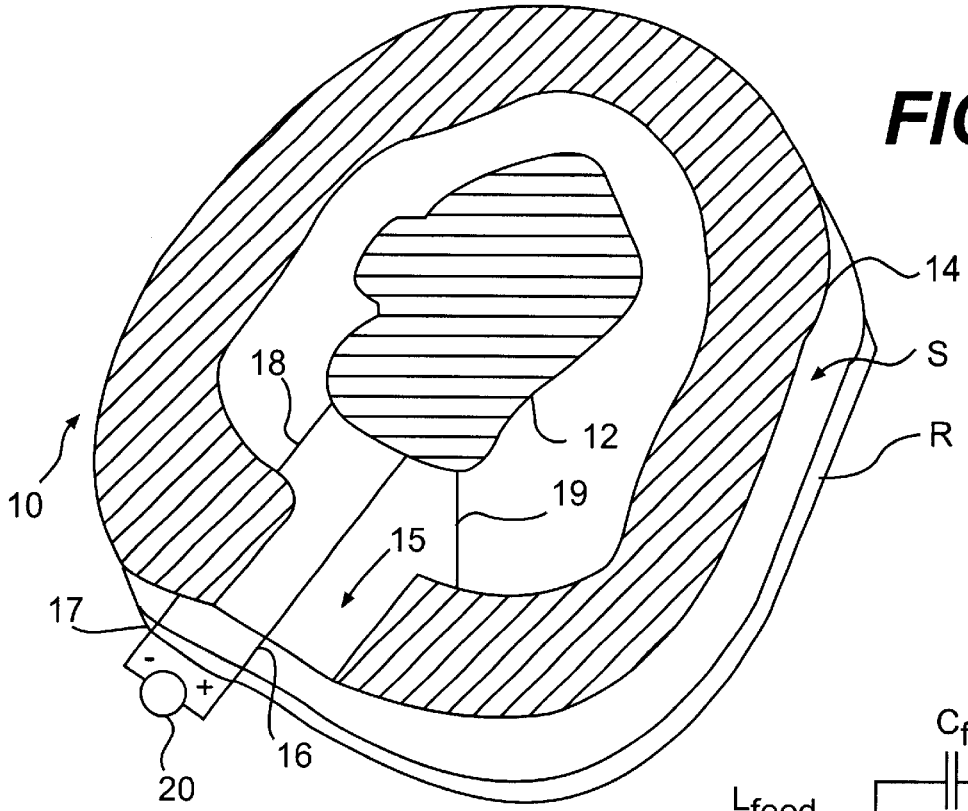

In the appended FIG. 1 is depicted the general architecture of an antenna 10 in accordance with the present invention, comprising:

a first electrically conductive surface 12, generally dubbed a "capacitive roof", a second electrically conductive surface 14 forming a ground plane, parallel to the first surface, a first electrically conductive feed wire or strip 16 which links a first terminal of a generator/receiver 20 to the first surface 12 and a second feed wire or strip 17 which links a second terminal of the generator/receiver 20 to the second surface 14, and at least two electrically conductive wires or strips which link the two aforesaid surfaces 12 and 14, the two surfaces 12, 14 and the linking wires or strips 16, 17, 18 and 19 ensuring the link between these surfaces 12, 14 and the generator/receiver 20 on the one hand and between these surfaces 12, 14 on the other hand, all being coplanar according to the essential characteristic of the present invention.

The first surface 12 can take any geometry. This geometry and the magnitude of this surface 12 are however characteristic of the operation of the antenna.

The second surface 14 forming a ground plane, partially or completely surrounds the first surface 12. According to the diagrammatic representation given in FIG. 1, the ground plane 14 has the shape of an open ring which almost totally surrounds the surface 12. The opening 15 made in the ground plane 14 serves for the passage of the strip 16.

According to the representation given in FIG. 1 appended, there are provided two strips 18 and 19 linking together the surfaces 12 and 14. As indicated in the document EP-A-667 984, in this case the strips 18 and 19 are preferably symmetric with respect to the feed strip 16, and for example parallel to the latter.

As a variant however there may be provided a single strip for ensuring the link between the surfaces 12 and 14. An embodiment thus comprising a single feed strip for linking together the surfaces 12 and 14, will be described with regard to FIG. 4.

According to yet other variants, the antenna in accordance with the invention can comprise more than two strips 18, 19 so as to ensure the link between the surfaces 12 and 14.

Such an antenna can be obtained by various manufacturing procedures.

By way of non-limiting examples, this antenna 10 can be cut out from a conductive plane, a preferably metal plate, for example by etching the metallization of a single-sided printed circuit, or else by screenprinting onto an electrically insulating support, deposition on such an electrically insulating support, or production from a metal foil of suitable geometry.

The antennas in accordance with the present invention can operate at all frequencies.

The dimensions of the antenna in the metal plane are of the order of from $\lambda/6$ to $\lambda/5$ where $\lambda$ represents the working wavelength.

The person skilled in the art will understand that the thickness of the antenna is for its part extremely small. This thickness corresponds to the thickness of the elements 12 to 19 and of their support.

The antenna is matched to the impedance of the generator 20 (in general 50 Ω) over the working frequency band so as to obtain an acceptable SWR, preferably lying between 1.5 and 2.

Figure 2:
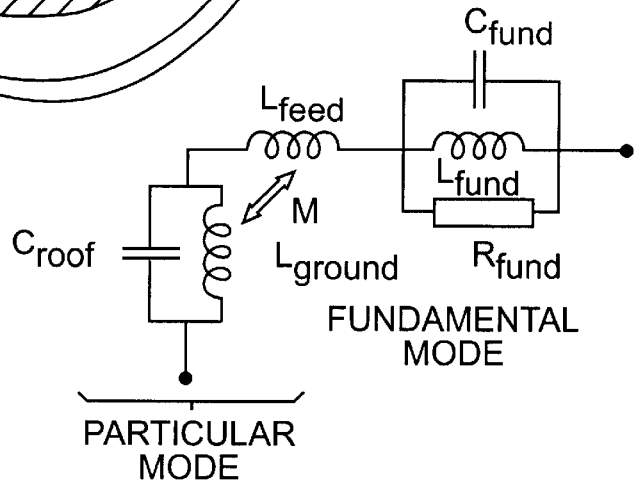
FIG. 2 represents the equivalent diagram of this antenna.

The equivalent diagram of this antenna is illustrated in FIG. 2.

This equivalent diagram comprises a cell comprising a capacitance Cfund, a choke Lfund and a resistor Rfund, connected together in parallel and corresponding to the fundamental mode, another cell comprising a capacitor Croof and a choke Lground connected together in parallel and a linking choke Lfeed ensuring a series link between the aforesaid two cells, the choke Lfeed being coupled with the choke Lground through a mutual inductance M.

Croof represents the capacitance between the two surfaces 12 and 14 measurable in the static regime.

Lground represents the inductance related to the strip(s) 18, 19.

Lfeed represents the inductance related to the feed strip 16.

The mutual inductance M is the result of the interaction between the strips 16, 18 and 19.

Figure 3:
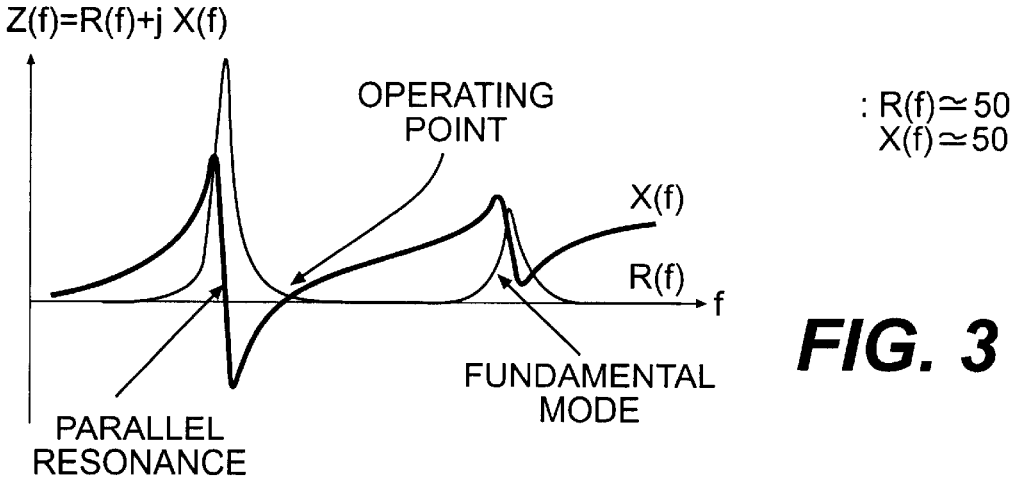
FIG. 3 represents the response of this antenna versus frequency and locates the operating point.

The response curve of this modelled antenna, versus frequency, real part R(f) and imaginary part X(f), is illustrated in FIG. 3.

Referenced in this FIG. 3 are, on the one hand, the graph of the response with regard to the fundamental mode and on the other hand the graph of the response with regard to the parallel resonance related to the original principle of operation of such antennas. This resonance is manifested as a resonance peak for the real part R(f) and by an oscillation for the imaginary part X(f). This resonance peak of the input impedance of the antenna is the consequence of the capacitive effect of the two plates 12 and 14 and of the self-induction and mutual induction effects of the strips 16, 18 and 19. The person skilled in the art will be able to evaluate these elements by making the quasi-static state approximation.

The operating band of the antenna is located around the zeroing frequencies of the imaginary part X(f) of the input impedance and corresponds to a real part R(f) around that of the generator 20.

Most of the radiation emitted by the antenna originates from the strip(s) 18, 19 and corresponds to a radiation of bipolar quasi omnidirectional type in the plane perpendicular to the strips and whose polarization in this plane is parallel to the strips. It is the conventional radiation of an electric dipole in a plane which is perpendicular thereto. This dipole would be parallel to the wires 16 and 18.

As was suggested previously a dielectric substrates can be added on and/or under the metal plane defined by the elements 12 to 19, so as to strengthen the structure, so as to reduce the dimensions of the antenna with respect to the operating wavelength, so as to generate a radiation in the dielectric, etc.

Moreover a proximity reflector R can be associated with the antenna so as to shape the radiation, for example so as to concentrate the radiation in a desired direction.

The particular embodiment illustrated in FIG. 4 will now be described.

Figure 4:
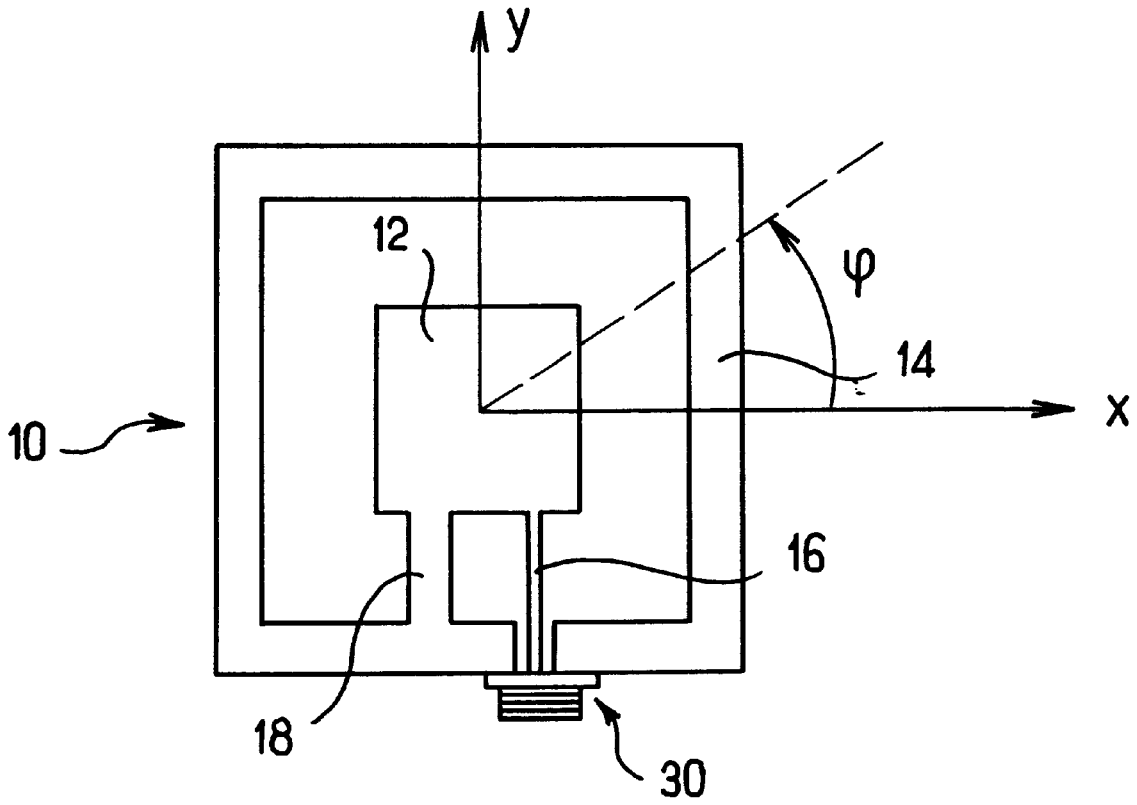
FIG. 4 represents a particular embodiment of the present invention.
Figure 4:
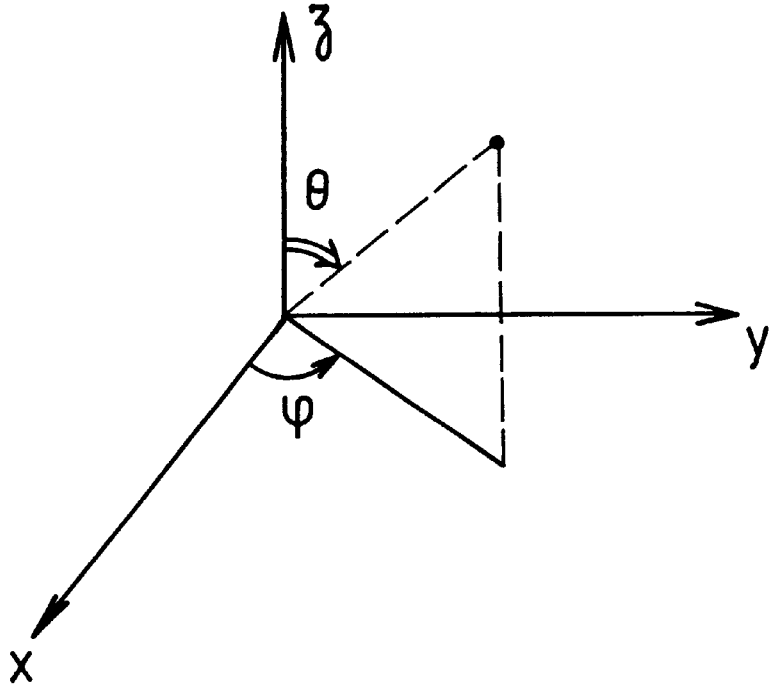

The antenna 10 illustrated in this FIG. 4 is formed by cutting out from a metal sheet 0.4 mm thick.

It comprises a roof 12 of square geometry 25 mm×25 mm, i.e. of the order of $\lambda/12\times\lambda/12$.

The ground plane 14 is formed by a strip of width 6 mm, i.e. of the order of $\lambda/50$, and of square geometry which almost totally surrounds the roof 12.

Thus the ground plane 14 is formed by four rectilinear segments of strip, which are perpendicular and parallel to one another pair-wise, each typically possessing an outside length of 65 mm, i.e. of the order of $\lambda/5$, and a width of 6 mm, i.e. of the order of $\lambda/50$.

The roof 12 is preferably centred on the ground plane 14 and has its sides parallel to the segments of the strip forming this ground plane 14. Thus, the distance separating the inner edge of the ground plane 14 and the outer edge of the roof 12 is of the order of 14 mm.

One of the aforesaid segments forming the ground plane 14 possesses a transverse cutout 15 of a width of the order of 5 to 8 mm.

This cutout 15 is preferably formed at around 37 mm from one end of this segment and around 23 mm from the other end of the same segment of ground plane.

A rectilinear ground strip 18 of width 8 mm and length of the order of 14 mm links the inner edge of the segment 14 possessing the cutout 15 and the roof 12. This ground strip 18 thus extends perpendicularly to the segment 14 and to the edge of the roof 12. This ground strip 18 is preferably joined up to the longest element of the strip 14 possessing the cutout 15 and is preferably joined up to the roof at a distance of the order of 4 mm from one of its corners.

The feed strip 16 is formed by a rectilinear strip, centred on the cutout 15, of a width of the order of 3 mm and which joins up perpendicularly to one side of the roof 12, preferably at a distance from a corner thereof of the order of 4 mm.

As may be seen in FIG. 4, the ground strip segment 14 possessing the cutout 15 is furnished with a connector 30 whose outer shielding is joined electrically to the earth strip 14 and whose central conductive rod is joined by any appropriate means to the outside end of the feed strip 16.

Figure 5:
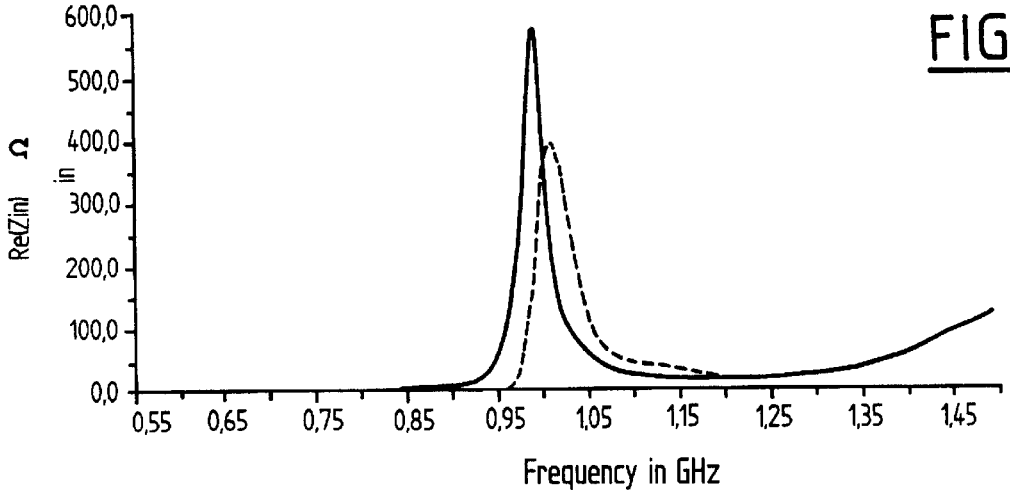
FIG. 5 represents the graph of the real part of the input impedance, versus frequency, plotted for an antenna in accordance with the embodiment illustrated in FIG. 4.

FIG. 5 represents the real part R(f) of the input impedance of the antenna 10 illustrated in FIG. 4, in Ω, as a function of frequency.

Figure 6:
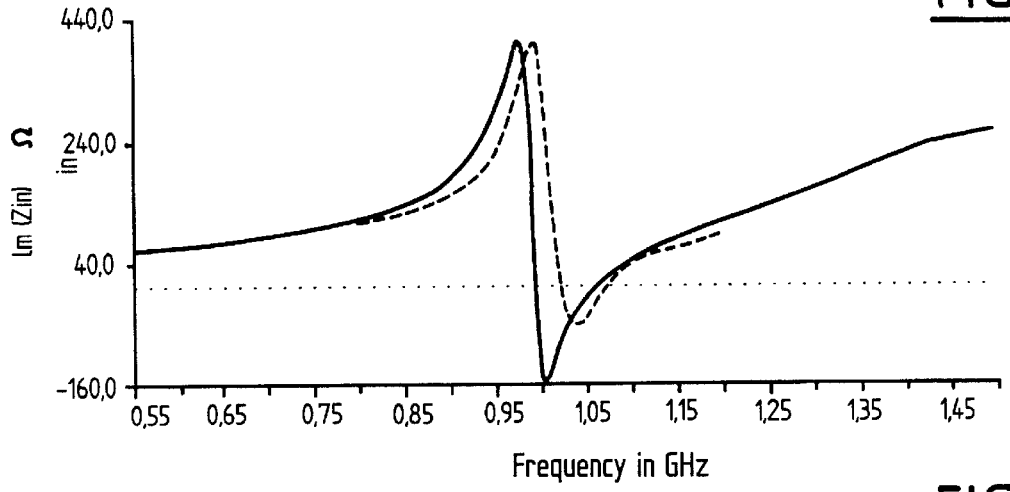
FIG. 6 represents the graph of the imaginary part of the input impedance, versus frequency, plotted for an antenna in accordance with the embodiment illustrated in FIG. 4.

FIG. 6 represents the imaginary part X(f) of the input impedance of the same antenna 10 illustrated in FIG. 4, in Ω, as a function of frequency.

Figure 7:
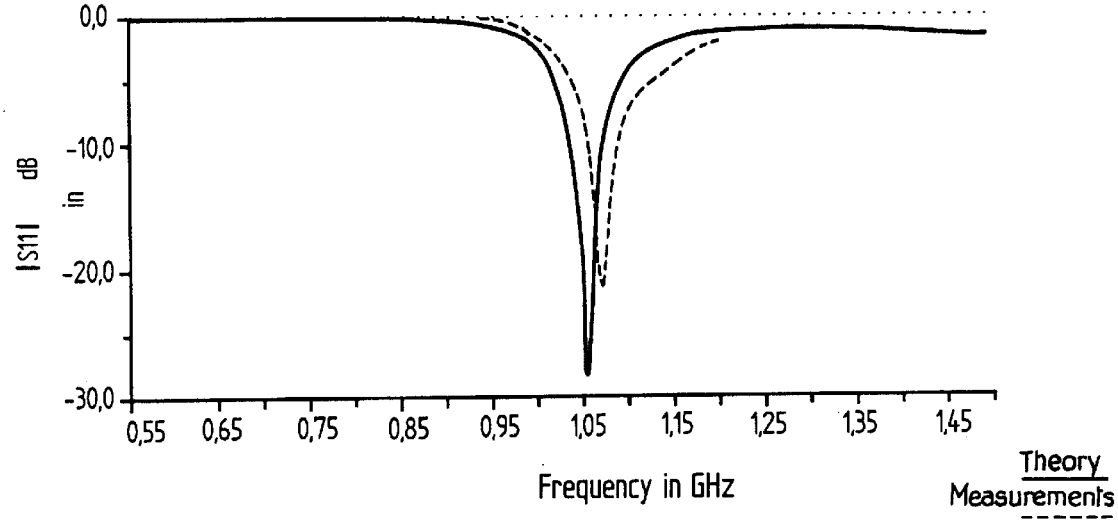
FIG. 7 represents the graph of the reflection coefficient resulting therefrom, versus frequency, for an antenna in accordance with the embodiment illustrated in FIG. 4, (it will be noted that in FIGS. 5, 6 and 7, the theoretical values are illustrated by solid lines, whilst the measured values are illustrated by broken lines)

And FIG. 7 represents the resulting reflection coefficient $|S_{11}|$.

More precisely in FIGS. 5 to 7 the theoretical curves have been illustrated with continuous lines and the real curves measured on an antenna in accordance with FIG. 4 have been illustrated by broken lines.

The theoretical reflection coefficient $|S_{11}|$ is a minimum (−28 dB) at 1.057 GHz and the measured real reflection coefficient $|S_{11}|$ is a minimum (−21.3 dB) at 1.07 GHz.

The overall dimensions of the device 10: antenna plus ground plane, illustrated in FIG. 4, are of the order of from $\lambda/6$ to $\lambda/5$ where $\lambda$ is the working wavelength.

Figure 8:
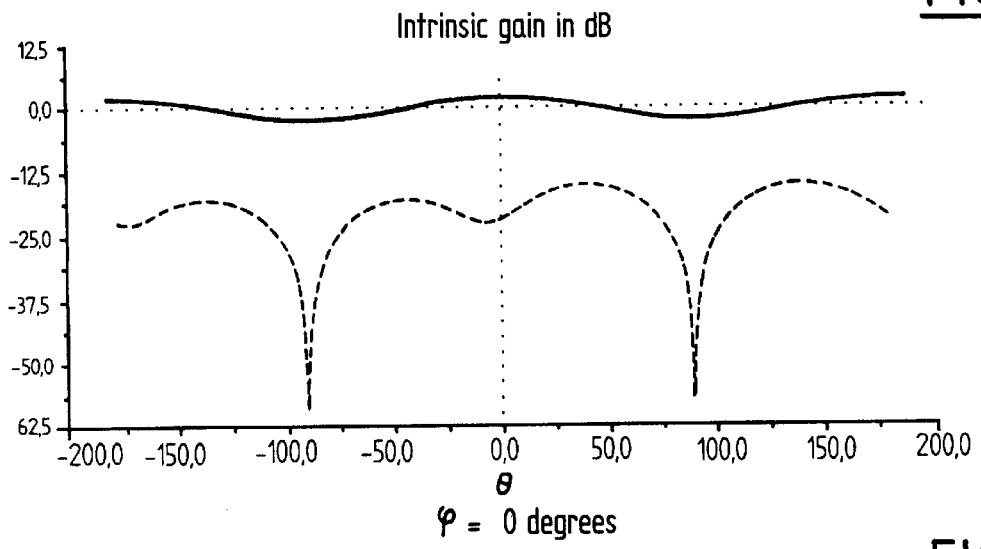
FIGS. 8, 9 and 10 represent the intrinsic gain of the antenna in dB for various planes.
Figure 9:
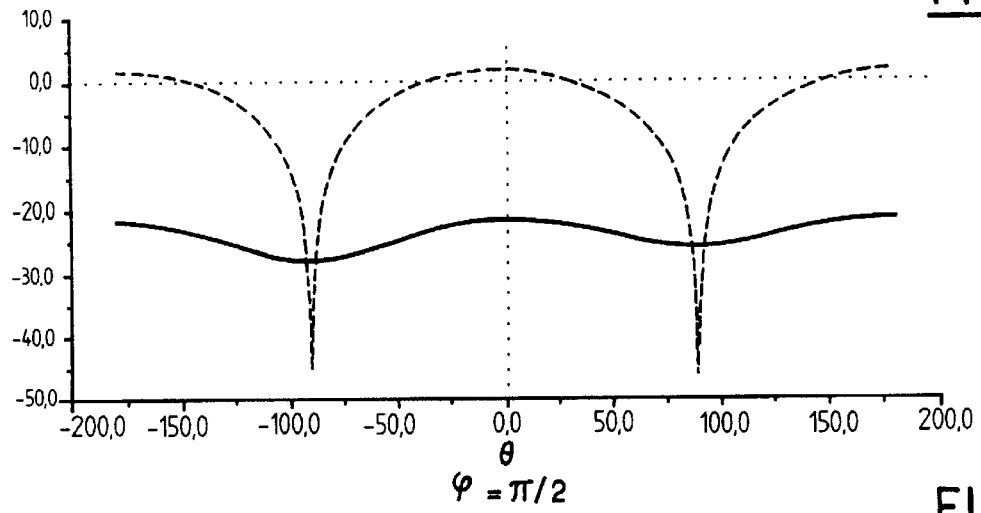
Figure 10:
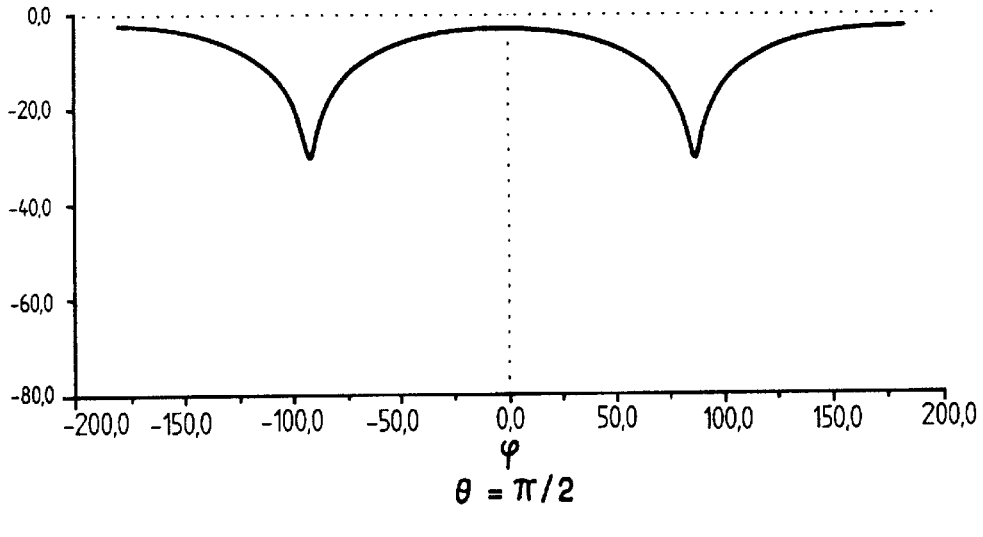

The intrinsic gain at the frequency of 1.06 GHz, illustrated in FIGS. 8 to 10, stems from almost omnidirectional radiation in the plane orthogonal to the strips 18, 19 in accordance with the dipole radiation principle.

FIG. 8 represents the gain versus the angle θ between the direction of observation and a perpendicular to the metal plane, in the plane of the strip 16 (i.e. $\phi=0°$).

FIG. 9 represents the gain versus the angle θ between the direction of observation and a perpendicular to the metal plane, in a plane perpendicular to the strip 16 (i.e. ($\phi=90°$).

FIG. 10 represents the gain in the plane of the antenna ($\theta=90°$ ) versus the azimuth φ of observation in this plane.

There are a large number of known antennas, including planar antennas.

By way of non-limiting examples may be cited:

1) planar resonant structures of the "microstrip" type composed of stacked elements with at least two levels of metallization for example a ground plane, a dielectric substrate which may be air and a metal radiating element; belonging to this family for example are radiating "patch" antennas based on the principle of resonant cavities with leakages generating narrow operating bands (whose dimension is at least of the order of $\lambda g/2$, $\lambda g$ representing the wavelength in the dielectric) and microstrip "wire-plate" antennas, such as described in the document EP-A-667 984 of the same structure as the preceding patch antennas but which work on a different principle and which allow matching at frequencies of around $\lambda/8$, and 2) "planar" structures which comprise just a single metal plane element which constitutes the antenna and is generally associated with a dielectric substrate in order to stiffen the assembly; these antennas do not require any ground plane a priori, but most of the time are arranged parallel to such a plane so as to allow correct power feed.

The following for example belong to this second family:

resonant electric and magnetic dipoles in their printed-on substrate version, which differ from "patch" antennas only through the resonant mode which is that of a metal plate rather than a cavity, resonating slot antennas, and travelling wave planar structures consisting of segments of microstrip or coplanar lines matched at the ends, the principal characteristic of these antennas is their large dimension with respect to the wavelength so as to obtain good efficiency.

Thus the inventors do not know of any existing antenna complying with the structure in accordance with the present invention previously defined and exhibiting in particular the following advantages:

small antenna dimension with respect to wavelength, i.e. of the order of from $\lambda/6$ to $\lambda/5$, ground plane included, planar antenna possessing only a very small thickness, wide frequency band relative to conventional resonant antennas, dipole radiation into space, easy associating of ground planes and substrates.

It will also be noted that the present invention makes it possible to produce antennas at very low cost, with great ease of production.

The present invention can find application in a large number of fields. By way of non-limiting examples may be cited antennas for automobiles, antennas for wireless link, millimetre antennas for sectorial distribution, "lens" and "parabola" antenna sources, antennas for cordless telephony, etc.

Of course the present invention is not limited to the particular embodiment just described, but extends to all variants in accordance with the spirit thereof. Advantageously, for certain applications where the radiation is desired to be directional in the plane $\phi=0$ rather than omnidirectional, a reflector plane can be appended to the antenna, the former being parallel to the latter and situated a distance of the order of $\lambda/20$ away.

According to the embodiment shown diagrammatically in FIG. 1, the two strips 16, 17 ensuring the link between the generator/receiver 20 and respectively the first surface 12 and the second surface 14, are coplanar with these latter. According to the embodiment shown diagrammatically in FIG. 4, only the strip 16 ensuring the link between the generator/receiver 20 and the first surface 12 is coplanar with the surfaces 12 and 14, the link between the generator/receiver 20 and the second surface 14 being ensured directly by way of the ground of a coaxial socket. As a variant however, it is possible to envisage that neither the strip 16 nor the strip 17 is coplanar with the surfaces 12 and 14. For this, it is for example possible to provide for a power feed to the said surfaces 12, 14 from above.

According to yet another variant, the surface forming the roof can be split into several coplanar elements, or even be perforated, as indicated in the document EP-A-667984.

What is claimed is:

1. An antenna of the type comprising:

a first electrically conductive surface (12), a second electrically conductive surface (14) forming a ground plane parallel to the first electrically conductive surface, a first electrically conductive feed wire or strip (16), which links a first terminal of a generator/receiver (20) to the first electrically conductive surface (12), a second electrically conductive feed wire or strip (17), which links a second terminal of a generator/receiver (20) to the second electrically conductive surface (14), and at least one electrically conductive wire or strip (18, 19), which links the first electrically conductive surface (12) and the second electrically conductive surface (14), wherein the first electrically conductive surface, the second electrically conductive surface, and said at least one electrically conductive wire or strip (18, 19) linking said first and second electrically conductive surfaces (12, 14) are all coplanar.

2. The antenna according to claim 1, wherein at least the first electrically conductive feed wire or strip (16) linking the generator/receiver (20) and the first electrically conductive surface (12) is also coplanar with the first and second electrically conductive surfaces (12, 14).

3. The antenna according to one of claims 1 or 2, wherein at least the second electrically conductive feed wire or strip (17) linking the generator/receiver (20) and the second electrically conductive surface (14) is also coplanar with the first and second electrically conductive surfaces (12, 14).

4. The antenna according to one of claims 1 or 2, wherein the second electrically conductive surface (14) forming a ground plane at least partially surrounds the first electrically conductive surface (12).

5. The antenna according to one of claims 1 or 2, wherein the second electrically conductive surface (14) forming a ground plane has the shape of an open ring, which almost totally surrounds the first electrically conductive surface (12).

6. The antenna according to claim 5, wherein an opening (15) made in the ground plane of the second electrically conductive surface (14) serves for passage of the wire or strip (16) ensuring the link between the generator/receiver (20) and the first electrically conductive surface (12).

7. The antenna according to claim 1, which comprises at least two electrically conductive wires or strips (18, 19) linking together the first and second electrically conductive surfaces (12, 14).

8. The antenna according to claim 1, which is made by cutting out from a conductive plane by etching the metallization of a single-sided printed circuit.

9. The antenna according to claim 1, having dimensions in the plane of the electrically conductive surfaces (12, 14) of about $\lambda/6$ to $\lambda/5$, where $\lambda$ represents the working wavelength.

10. The antenna according to claim 1, which comprises a dielectric substrate on the plane of the first and second electrically conductive surfaces (12, 14).

11. The antenna according to claim 1, which further comprises an associated proximity reflector for shaping radiation.

12. The antenna according to claim 1, which comprises a first surface (12) of square geometry and a ground plane of the second electrically conductive surface (14) formed of four rectilinear segments of strip, perpendicular and parallel to one another pair-wise, which almost totally surround the electrically conductive first surface (12), one of the aforesaid segments forming the ground plane of the second electrically conductive surface (14) possessing a transverse cutout (15) for the passage of a first electrically conductive strip (16) ensuring the link between the generator/receiver (20) and the first electrically conductive surface (12).

13. The antenna according to claim 12, which further comprises a rectilinear electrically conductive ground strip (18), which links an inner edge of the electrically conductive surface (14) possessing the cutout (15) and the first electrically conductive surface (12) and extends perpendicularly on their edge.

14. The antenna according to claim 12, which comprises a first electrically conductive surface (12) of square geometry whose sides have a length of the order of $\lambda/12$ and a ground plane of electrically conductive surface (14) formed of four rectilinear segments of strip, perpendicular and parallel to one another pair-wise, of a length of about $\lambda/5$ and of a width of about $\lambda/50$, which almost totally surrounds the first electrically conductive surface (12).

15. The antenna according to claim 1, which comprises a connector (30) having outer shielding joined electrically to the ground plane of the second electrically conductive surface (14) and having a central conductive rod that is joined to the first electrically conductive strip (16) ensuring the link between the generator/receiver (20) and the first electrically conductive surface (12).

* * * * *